US008936206B1

(12) United States Patent
Wright

(10) Patent No.: US 8,936,206 B1
(45) Date of Patent: Jan. 20, 2015

(54) PROTECTIVE COVER FOR A SPRINKLER

(76) Inventor: James Wright, San Mateo, FL (US)

( * ) Notice: Subject to any disclaimer, the term of this patent is extended or adjusted under 35 U.S.C. 154(b) by 369 days.

(21) Appl. No.: 13/422,338

(22) Filed: Mar. 16, 2012

(51) Int. Cl.
*B05B 1/24* (2006.01)
*B05B 15/04* (2006.01)
*B05B 15/06* (2006.01)

(52) U.S. Cl.
USPC ..... 239/288.5; 239/201; 239/288; 239/288.3

(58) Field of Classification Search
CPC .... B05B 15/001; B05B 15/06; B05B 15/061; B05B 15/062; B05B 15/063
USPC ..... 239/200, 201, 204, 205, 288, 288.3, 239/288.5; 137/363, 377, 378
See application file for complete search history.

(56) References Cited

U.S. PATENT DOCUMENTS 4,145,003 A 3/1979 Harrison et al.
4,582,256 A 4/1986 Jaquez
5,772,118 A * 6/1998 Fabiano ..... 239/276
6,138,924 A * 10/2000 Hunter et al. ..... 239/204
6,186,416 B1 * 2/2001 Jones ..... 239/288.5
6,553,795 B1 4/2003 Trempala
6,840,329 B2 1/2005 Kikuchi et al.
7,114,665 B1 10/2006 McTee
7,617,994 B2 * 11/2009 Gunderson et al. ..... 239/288.5
2001/0032890 A1 10/2001 Stephens
2005/0023375 A1 * 2/2005 Tanczos ..... 239/288
2010/0127099 A1 5/2010 Memole
2011/0198410 A1 8/2011 Curtis

* cited by examiner

*Primary Examiner* — Ryan Reis
(74) *Attorney, Agent, or Firm* — Lawrence J. Gibney, Jr.

(57) ABSTRACT

In order to protect the operation of and insure the life of a sprinkler system, this device will be placed in the ground and will provide a protective cover for an individual sprinkler mechanism. The device will prevent the entry of debris into the sprinkler mechanism but also not interfere with the normal operation of the sprinkler. Additionally this will also allow the performance of routine maintenance on the sprinkler heads without the necessity of removing the entire sprinkler assembly.

3 Claims, 6 Drawing Sheets

PROTECTIVE COVER FOR A SPRINKLER

BACKGROUND OF THE INVENTION

A. Field of the Invention

This relates to irrigation systems and, in particular, the protection and maintenance of sprinkler heads in irrigation systems.

B. Prior Art References

There are many other prior art references to irrigation equipment and, in particular, irrigation sprinkler head cover assemblies, including Kikuchi, U.S. Pat. No. 6,840,329 and Hunter, U.S. Pat. No. 6,138,924. These are merely representative examples of a large number of patent application products that protect sprinkler heads.

However, none of the prior art operates in the same manner as the current device.

Specifically the prior art requires that the user of the device dig a large hole and connect the device to the existing irrigation piping. The sprinkler head in turn is then connected to the vessel that has been connected to the existing irrigation lines. While this type of device would certainly address the issue of protecting the sprinkler head, it would require the user to dig a large hole and connect to the irrigation line; the maintenance issue of the sprinkler head would remain.

BRIEF SUMMARY OF THE INVENTION

One of the difficulties in maintaining irrigation system is the fact that, at times, sprinkler heads can be damaged. Typically these sprinkler heads are buried below the ground level and rise above the ground level when the system becomes operational. In order to insure that the sprinkler head provides full coverage for the area to be irrigated, the sprinkler head needs to rise a certain distance above the ground level. Over time grass may cover the sprinkler head and prevent it from fully deploying and thus preventing the system from properly irrigating the desired area.

The sprinkler head is buried below the ground surface to protect it from damage. However, each time that the sprinkler head is raised above the ground level, sand or other debris can enter the working mechanism of the sprinkler head.

Additionally, damage can occur from a variety of other causes. These causes may include damage by lawnmowers, small bicycles, and getting knocked while the sprinkler head is in the up position by children or animals or thrown objects.

Unfortunately when a sprinkler head is damaged, it requires a great deal of time and cost to make the repairs and it is generally inconvenient.

The largest problem from a maintenance perspective is the entry of foreign matter, particularly dirt into the working mechanism of the sprinkler head and this particular device will address that issue. The entry of sand and other debris will cause the sprinkler to fail prematurely or not operate as effectively as possible. Because the sprinkler heads are installed below the ground surface and only elevate when the system becomes operational, there is the risk that foreign matter will enter the sprinkler mechanism either interrupting the flow of water or damaging the internal mechanism of the sprinkler head.

This device will, in essence, be a protective cover for a sprinkler that will lie relatively flush against the level of the grass but slightly below the ground level. This will prove to be a protective covering for the sprinkler itself from damage caused by lawnmowers cars or bicycles from striking the sprinkler head.

The device will be designed to provide an internal cavity to protect the sprinkler head while at the same time permitting routing maintenance without needing to dig up the entire assembly. If foreign material enters the cavity, the matter can be removed from the cavity by simply blowing the matter from the cavity with an air blower. The area around the device can also be easily trimmed with a weed trimmer without any risk of damage to the sprinkler head.

This cavity will not in any way affect the operation of the sprinkler head and, in fact, will extend the life of the sprinkler head.

One of the other issues with sprinkler systems in terms of its effectiveness is the issue of the sprinkler head rising in a vertical fashion when deployed. If the sprinkler head rises at an angle because it has been bumped the spray is ineffective in terms of covering a particular area. With this device the bottom sleeve will position the sprinkler head assembly so that it will remain in a vertical alignment.

Additionally a seal in the bottom sleeve will prevent the ground from entering the sprinkler head assembly. When the sprinkler head is installed it is designed to be a snug fit through the bottom sleeve to maintain the appropriate alignment.

NUMBERING DESCRIPTION

5-Device
10-Top Flange
15-Inner Cavity
20-Bottom Sleeve
25-Sprinkler
30-Seal
35-Male connector piece
40-Female connector piece
45-Irrigation Line

DETAILED DESCRIPTION OF THE EMBODIMENTS

Irrigation systems are commonplace today. Typically a series of underground pipes connect a plurality of sprinkler heads that are installed in certain areas of the area to be irrigated. When the system is activated, the sprinkler heads will elevate slightly so that the stream of water will be above the ground level during the irrigation process. Most irrigation systems are controlled with timers so that the system is deployed on a certain schedule. Additionally most irrigation systems divide the area that is to be irrigated into zones for irrigation purposes. When a zone is irrigated, a predetermined number of sprinkler heads are deployed.

In the usual system, the sprinkler heads are buried slightly below the surface so that they are not seen until the system is activated. Unfortunately, the working mechanism is exposed to debris—particularly the ground soil—because the system is installed in the ground and is typically surrounded by the soil. When the system is operational and the sprinkler head rises above the ground some of the ground soil may enter into the sprinkler assembly because of its proximity to the assembly and the sprinkler head opening. When the sprinkler head is deployed, there is a risk of some of that debris entering the sprinkler mechanism causing premature wear and tear and shortening the life of the sprinkler head or reducing the sprinkler head's effectiveness.

With this device the working parts of the sprinkler head are protected from the possible entry of debris while also allowing routine maintenance to be performed without removal of the device from the ground. Additionally the device will insure that the sprinkler head remains in a vertical alignment so that the spray is appropriately distributed.

In order to protect the sprinkler heads, this device will be placed in the ground. One end of the sprinkler 25 will be connected to the irrigation line below the surface. The sprinkler will be inserted through a bottom sleeve 20.

A seal 30 or plurality of seals will probably be installed in the bottom sleeve and fit flush against the side of the sprinkler to prevent the entry of debris upwards into the sprinkler mechanism. The sprinkler 25 should fit snugly within the bottom sleeve to insure that it remains is a vertical alignment relative to the ground.

Figure 1:
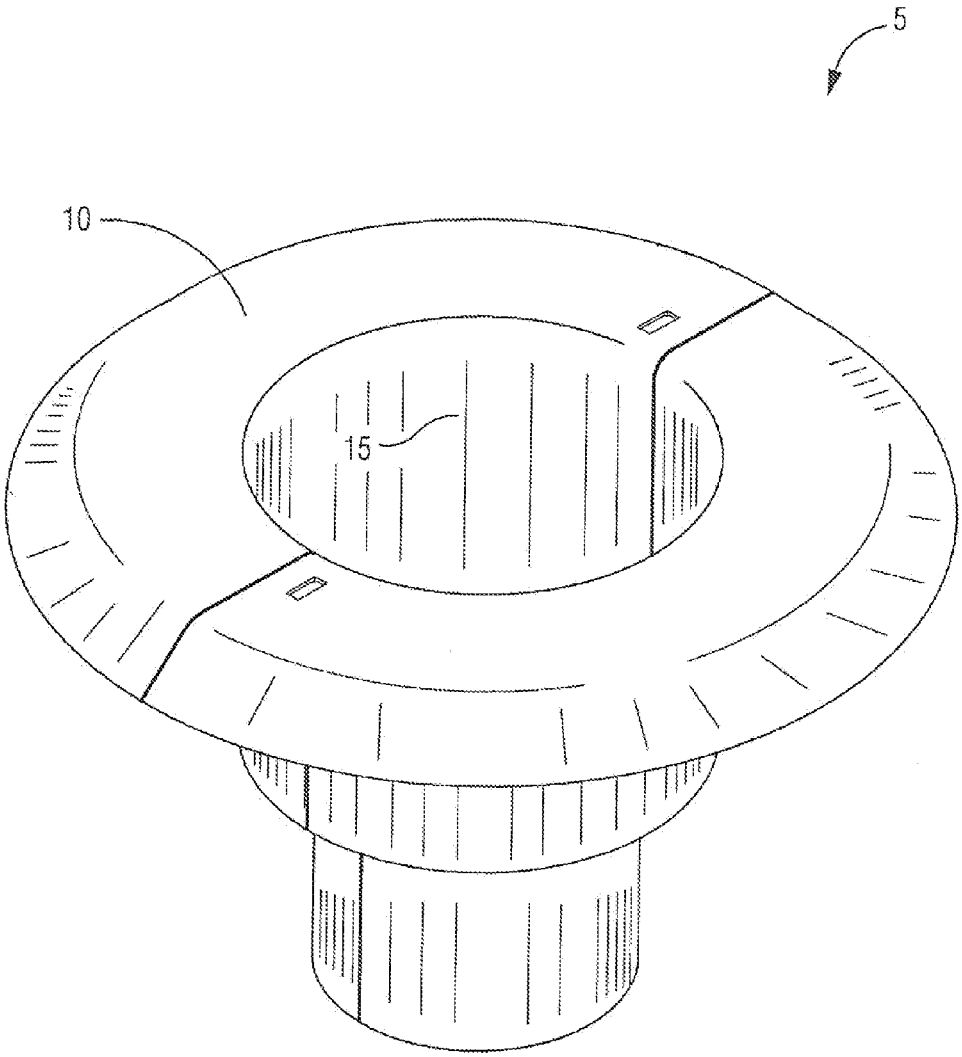
FIG. 1 is an isometric view of the device.
Figure 2:
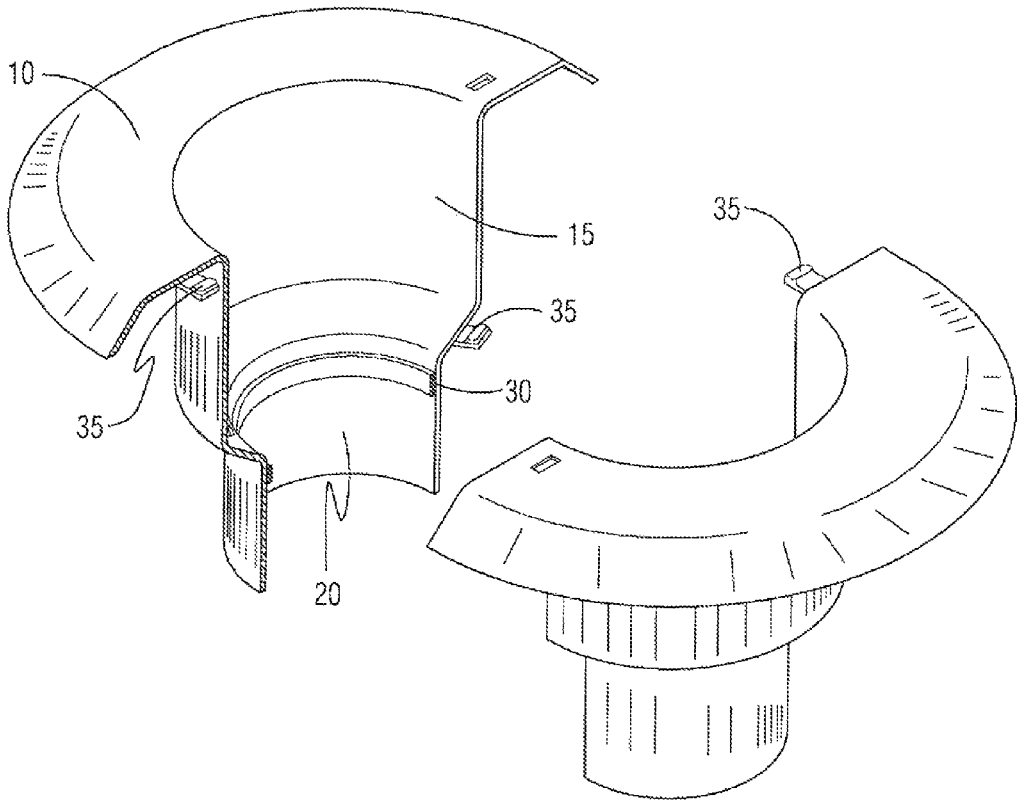
FIG. 2 is an exploded isometric view of the device.
Figure 3:
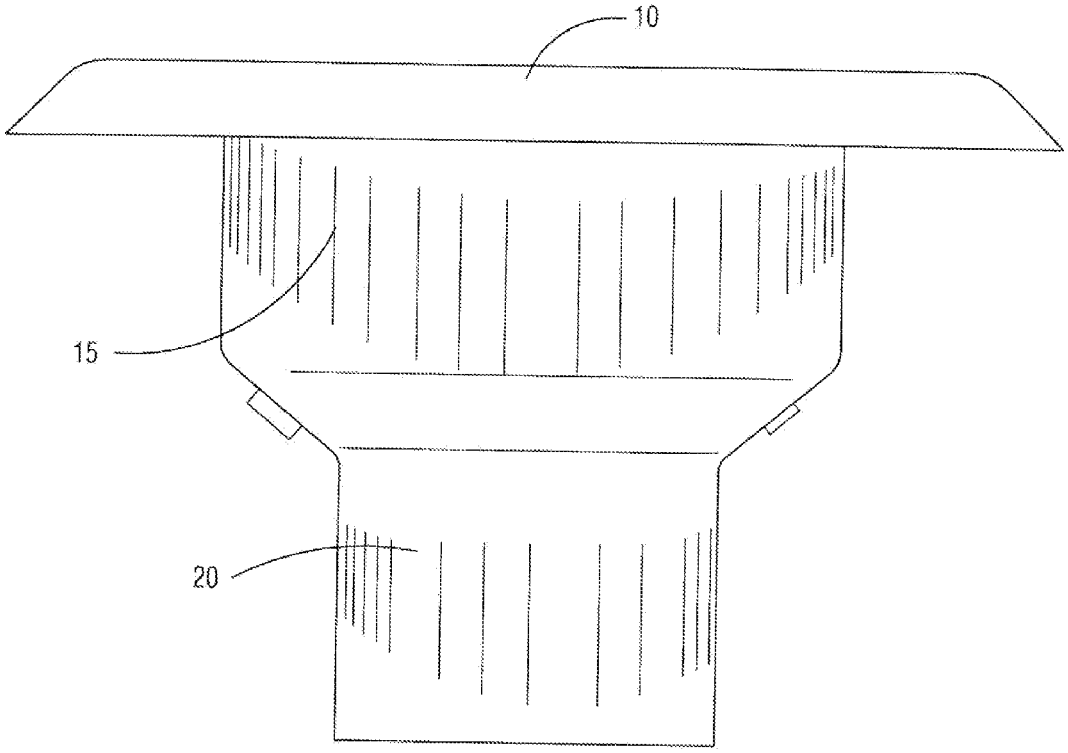
FIG. 3 is a side view of the device.
Figure 4:
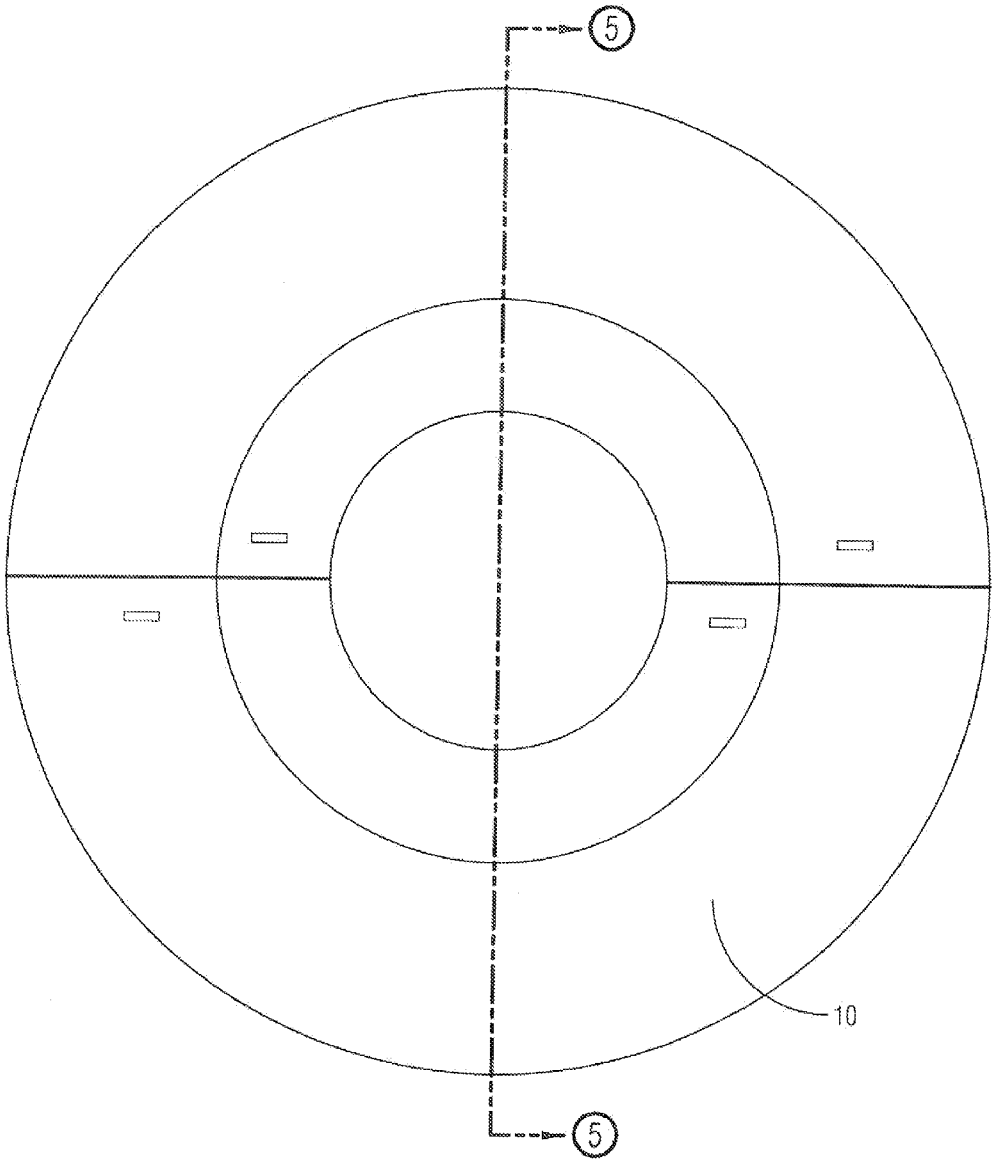
FIG. 4 is a top view of the device.
Figure 5:
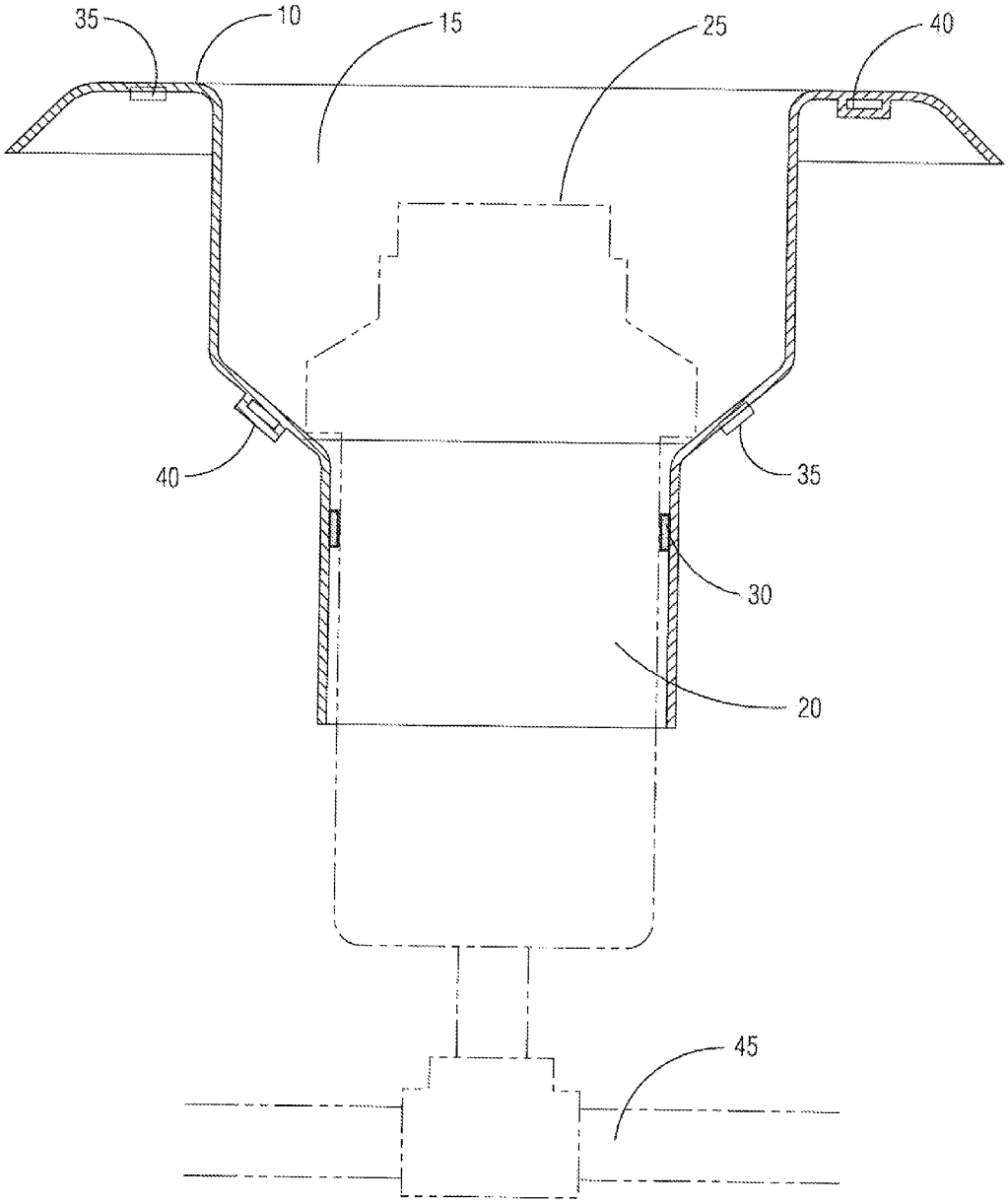
FIG. 5 is a cross-sectional view according to line 5-5 on FIG. 4 with the sprinkler assembly and irrigation line in dashed lines.

When the sprinkler is installed as depicted in FIG. 5, the inner cavity 15 will be protected from any ground contaminants such as dirt by the seal 30 on the bottom sleeve.

The top flange 10 will be long and wide enough to protect the sprinkler head from possible damage from lawnmowers, lawn equipment, children or thrown objects. The sprinkler head 25 itself will be positioned so that it is slightly below the top level of the flange 10 or slightly below the ground level to insure that the top of the sprinkler head is protected.

As part of the design of the device a cavity 15 is placed so that when the sprinkler head is installed it will remain flush with a portion of the cavity. This particular configuration allows routine maintenance to be performed to the sprinkler head 25 without needing to remove the entire sprinkler assembly or disconnecting it from the irrigation line 45 that is buried below the surface. The cavity 15 that is formed will collect debris from the ground surface such as grass clippings, dirt or other debris that is on the surface. This cavity can easily be cleaned by simply blowing the cavity 15 out with a blower. Additionally the area around the sprinkler head can be trimmed by a weed eater without risking damage to the head because the sprinkler head is placed below the ground surface.

Figure 6A:
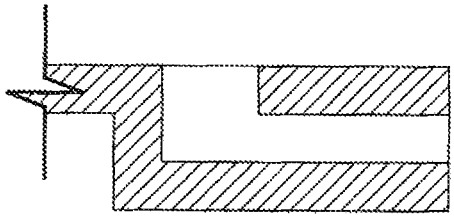
FIG. 6A is a fragmented view of the female portion of the means of connection.
Figure 6B:
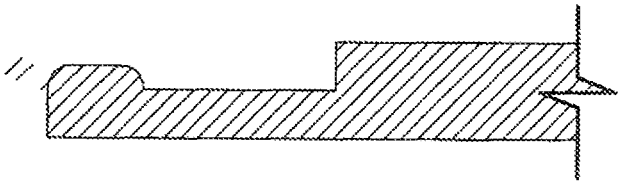
FIG. 6B is a fragmented view of male portion of the means of connection.

It is contemplated that the device will be manufactured in two sections that can be put together and similarly removed. As depicted in FIGS. 6A and 6B there will be a female connector piece 40 that will mate with the male connector piece 35 thus forming one distinct piece. Although a tab and slot means of connection is depicted, other types of means of connection may also be used. The primary purpose of the means of connection is to make sure that the sections can be mated or detached in the event that repairs are needed for the device. The device can be detached into two sections so that if one section is damaged, it can easily be replaced.

Another advantage to this design is that it will prevent the head from becoming cocked if it has been jarred or knocked; if the sprinkler head becomes cocked, it will increase the risk of damage to the sprinkler head and also cause stress to the connection at the junction of the underground irrigation piping and the end of the sprinkler head. Additionally a cocked sprinkler head will cause the sprinkler from effectively irrigating a particular area. Because a sufficient area of the head is placed in the cavity and held in place because of the snug fit and the seal, there is an extremely small risk of the sprinkler head becoming cocked.

For ease of installation the portion of the device that will form the cavity is beveled so that it can be pushed into the ground. The top flange is beveled so that the flange surface will fit flush across the top surface of the ground.

While the embodiments of the invention have been disclosed, certain modifications may be made by those skilled in the art to modify the invention without departing from the spirit of the invention.

The invention claimed is:

1. A device to protect a sprinkler head, which is comprised of:

a. two sections;
said sections are of a predetermined shape;
wherein there is a first section and a second section;
wherein a means of connection to connect the sections is provided;
b. a top flange;
wherein the top flange is of a predetermined shape;
wherein the top flange is beveled;
said top flange is connected to an inner cavity;
wherein a male connector piece is located on the top flange surface of the first section;
wherein a female connector piece is located on the top flange surface of the second section;
wherein said female connector piece is opposed to said male connector piece;
c. an inner cavity;
wherein the cavity is of a predetermined shape;
wherein the sprinkler head is placed within the inner cavity;
d. a bottom sleeve;
wherein the bottom sleeve is of a predetermined shape;
said bottom sleeve is connected to the inner cavity;
wherein a portion of the sprinkler head passes through the bottom sleeve;
e. a seal;
wherein the seal is placed within the bottom sleeve to provide a snug fit for the sprinkler head;
wherein the seal prevents debris from moving upward from the ground into the inner cavity;
wherein the sprinkler head is attached to a portion of underground irrigation piping.

2. The device as described in claim 1 wherein a plurality of seals is used.

3. The device as described in claim 1 wherein the inner cavity is beveled.

* * * * *